US009951970B2

(12) United States Patent
Shimada et al.

(10) Patent No.: US 9,951,970 B2
(45) Date of Patent: Apr. 24, 2018

(54) IMMEDIATE HOT-WATER SUPPLYING SYSTEM

(71) Applicant: RINNAI CORPORATION, Nagoya-shi, Aichi (JP)

(72) Inventors: Shigeki Shimada, Aichi (JP); Ai Yuge, Aichi (JP)

(73) Assignee: RINNAI CORPORATION, Nagoya-Shi (JP)

( * ) Notice: Subject to any disclaimer, the term of this patent is extended or adjusted under 35 U.S.C. 154(b) by 54 days.

(21) Appl. No.: 14/587,079

(22) Filed: Dec. 31, 2014

(65) Prior Publication Data

US 2016/0187028 A1 Jun. 30, 2016

(51) Int. Cl.

| | |
|---|---|
| ***F24H 9/20*** | (2006.01) |
| ***F24H 1/14*** | (2006.01) |
| ***F24D 17/00*** | (2006.01) |
| ***F24D 19/10*** | (2006.01) |

(52) U.S. Cl.

CPC ..... *F24H 9/2035* (2013.01); *F24D 17/0026* (2013.01); *F24D 19/1051* (2013.01); *F24H 1/145* (2013.01); *F24D 2200/043* (2013.01); *F24D 2220/044* (2013.01)

(58) Field of Classification Search

CPC ..... F22B 35/008; F22B 35/18; F22B 35/007; G05D 27/02; F24H 9/2035; F24H 1/145; F24D 19/1051; F24D 17/0026; F24D 2200/043; F24D 2200/044

See application file for complete search history.

(56) References Cited

U.S. PATENT DOCUMENTS

| | | | | |
|---|---|---|---|---|
| 2,780,206 | A * | 2/1957 | La Rocque | F22B 31/04 122/448.3 |
| 5,775,581 | A * | 7/1998 | Welden | F24D 12/02 237/56 |
| 7,819,334 | B2 * | 10/2010 | Pouchak | F23N 5/00 122/448.1 |
| 9,163,529 | B2 * | 10/2015 | Yamada | F22B 35/008 |
| 2002/0026904 | A1 * | 3/2002 | Maruyama | F24D 3/02 122/414 |

(Continued)

FOREIGN PATENT DOCUMENTS

| | | |
|---|---|---|
| JP | 2004-286397 | 10/2004 |
| JP | 2004286397 A * | 10/2004 |

*Primary Examiner* — Steven B McCallister
*Assistant Examiner* — Steven Anderson, II
(74) *Attorney, Agent, or Firm* — Rankin, Hill & Clark LLP

(57) ABSTRACT

An immediate hot-water supplying system 1 includes a P hot water supply device 10 configured to heat water flowing through a first supply pipe 2, an N hot water supply device 30 configured to heat water flowing through a second supply pipe 3, a check valve 6, and a coupled controller 60 configured to, when the flow amount detected by a second flow amount sensor 34 is equal to or more than a hot-water-supply detection flow amount, perform a hot-water supply operation in which a first burner 12 or a second burner 32 is burned with a circulation pump 16 stopped, and when the flow amount detected by the second flow amount sensor 34 is less than the hot-water-supply detection flow amount, perform a circulation heat keeping operation in which the first burner 12 is burned with the circulation pump 16 activated.

5 Claims, 5 Drawing Sheets

(56) References Cited

U.S. PATENT DOCUMENTS

| | | | | |
|---|---|---|---|---|
| 2012/0090341 | A1* | 4/2012 | Hatada | F25B 27/00 62/238.7 |
| 2012/0090560 | A1* | 4/2012 | Iwama | F24H 1/145 122/14.3 |
| 2012/0138149 | A1* | 6/2012 | Hatada | F24H 1/10 137/1 |
| 2012/0216998 | A1* | 8/2012 | Kim | F24D 19/1051 165/200 |
| 2013/0126627 | A1* | 5/2013 | Paine | F24H 9/2035 237/8 B |
| 2013/0247997 | A1* | 9/2013 | Ng | F24H 1/107 137/13 |

* cited by examiner

[CIRCULATION HEAT KEEPING OPERATION]

[HOT-WATER SUPPLY OPERATION]

FIG.5A

| CONNECTOR No. | 4 | 5 | 1 | 2 | 3 |
|---|---|---|---|---|---|
| CONNECTED HOT WATER SUPPLY DEVICE | P HOT WATER SUPPLY DEVICE 10 | P HOT WATER SUPPLY DEVICE 20 | N HOT WATER SUPPLY DEVICE 30 | N HOT WATER SUPPLY DEVICE 40 | N HOT WATER SUPPLY DEVICE 50 |
| DEGREE OF PRIORITY | 1 | 2 | 3 | 4 | 5 |
| WATER-VOLUME SERVO | OPEN | OPEN | OPEN | CLOSE | CLOSE |

FIG.5B

| CONNECTOR No. | 1 | 2 | 3 |
|---|---|---|---|
| CONNECTED HOT WATER SUPPLY DEVICE | N HOT WATER SUPPLY DEVICE 30 | N HOT WATER SUPPLY DEVICE 40 | N HOT WATER SUPPLY DEVICE 50 |
| DEGREE OF PRIORITY | 1 | 2 | 3 |
| WATER-VOLUME SERVO | OPEN | CLOSE | CLOSE |

| CONNECTOR No. | 4 | 5 |
|---|---|---|
| CONNECTED HOT WATER SUPPLY DEVICE | P HOT WATER SUPPLY DEVICE 10 | P HOT WATER SUPPLY DEVICE 20 |
| DEGREE OF PRIORITY | 1 | 2 |
| WATER-VOLUME SERVO | OPEN | CLOSE |

IMMEDIATE HOT-WATER SUPPLYING SYSTEM

BACKGROUND OF THE INVENTION

Field of the Invention

The present invention relates to an immediate hot-water supplying system having a function of supplying hot water as soon as a hot-water tap is opened.

Description of the Related Art

An immediate hot-water supplying system has been known, which includes a supply pipe having one end connected to a waterworks and the other end connected to a hot-water tap, a plurality of hot water supply devices which are connected in the midway of the supply pipe and configured to heat water flowing through the supply pipe, a return pipe configured to bypass these hot water supply devices and connect the supply pipe, and a circulation pump configured to circulate water in a circulation circuit including the supply pipe and the return pipe (e.g., refer to Japanese Patent Laid-Open No. 2004-286397).

In the immediate hot-water supplying system described in the above publication, a circulation heat keeping operation is performed when the hot-water tap is closed and the supply of water is stopped, the circulation heat keeping operation in which water flowing through the hot water supply devices is heated while a circulation pump is activated and circulates the water in the circulation circuit. In such a manner, the immediate hot-water supplying system is configured to perform the circulation heat keeping operation to maintain the temperature of the water in the circulation circuit at around a set temperature, so as to supply hot water from the hot-water tap as soon as a user open the hot-water tap.

In addition, the immediate hot-water supplying system is configured to stop the circulation pump when hot water is supplied from the hot-water tap (in a hot-water supplying state). For this reason, in order to detect the hot-water supplying state, the immediate hot-water supplying system includes a first flow amount sensor configured to detect the flow amount of water flowing through the supply pipe, a second flow amount sensor configured to detect the flow amount of water flowing through the return pipe, and a third temperature sensor provided at a merging point of the water supply pipe and the return pipe.

Then, (a) when the detected temperature of the third temperature sensor rapidly decreases, and (b) when a difference between the flow amount detected by the first flow amount sensor and the flow amount detected by the second flow amount sensor becomes equal to or more than a predetermined flow amount, the circulation pump is stopped.

As described above, in the conventional immediate hot-water supplying system, the action of the circulation pump is typically stopped in the hot-water supplying state. Then, in the case of the inclusion of the second flow amount sensor configured to detect the flow amount of water flowing through the return pipe and the third temperature sensor provided at the merging point of the return pipe and the water supply pipe only to detect that it is in the hot-water supplying state, like the immediate hot-water supplying system, there is a disadvantage in that components are increased, which complicates a system configuration and increases a system cost.

The present invention has been made in view of the above background, and has an object to provide an immediate hot-water supplying system which can detect being in a hot-water supplying state without providing a dedicated sensor.

SUMMARY OF THE INVENTION

An immediate hot-water supplying system of the present invention includes:

a first supply pipe having one end connected to a waterworks and the other end connected to a hot-water tap;

a return pipe configured to communicate between the one end and the other end of the first supply pipe;

a first hot water supply device including a first heating unit which is connected on the way of the first supply pipe and configured to heat water flowing through the first supply pipe, and a circulation pump configured to circulate water in a circulation circuit composed of the first supply pipe and the return pipe;

a second supply pipe configured to communicate an upstream side and a downstream side of the first hot water supply device of the first supply pipe;

a second hot water supply device including a second heating unit which is connected on the way of the second supply pipe and configured to heat water flowing through the second supply pipe, and a second flow amount sensor configured to detect a flow amount of water flowing from the second supply pipe;

a check valve configured to enable water to flow from the second supply pipe to the second hot water supply device, and disable water from flowing from the second hot water supply device to the second supply pipe; and a controlling unit configured to, when the flow amount detected by the second flow amount sensor is less than a predetermined hot-water-supply detection flow amount, perform a circulation heat keeping operation in which the first heating unit is activated in a state the circulation pump is activated, and when the flow amount detected by the second flow amount sensor is equal to or more than the hot-water-supply detection flow amount, perform a hot-water supply operation in which at least one of the first heating unit and the second heating unit is activated in a state the circulation pump is stopped.

According to the present invention, when the circulation heat keeping operation is performed, the second hot water supply device does not suck water into the second heating unit using the circulation pump. Furthermore, the check valve prohibits water from flowing from the downstream side of the second supply pipe to the second hot water supply device. For this reason, the flow amount detected by the second flow amount sensor is less than hot-water-supply detection flow amount as long as the hot-water tap is closed.

Then, when the hot-water tap is opened, water flows to the hot-water tap from the second supply pipe via the second hot water supply device, and thus the flow amount detected by the second flow amount sensor becomes equal to or more than the hot-water-supply detection flow amount. For this reason, when the flow amount detected by the second flow amount sensor becomes equal to or more than the hot-water-supply detection flow amount in performing the circulation heat keeping operation, it is possible to determine that the hot-water tap is opened, and it is in the hot-water supplying state.

Then, the second flow amount sensor is typically provided in the second hot water supply device to prohibit the second hot water supply device from heating with the second heating unit while water does not flow in the second hot water supply device. For this reason, it is possible to detect being in a hot-water supplying state and to cause the controlling unit to perform the hot-water supply operation, without providing a dedicated sensor.

In addition, the immediate hot-water supplying system of the present invention, the second hot water supply device comprises a second water flow switching valve configured to switch between a water flowable state in which water is enabled to flow from the second supply pipe to the second heating unit, and a water unflowable state in which water is disabled from flowing from the second supply pipe to the second heating unit, and a plurality of second hot-water supplying units each including the second hot water supply device, the second supply pipe, and the check valve, wherein the controlling unit brings at least one of the plurality of second hot water supply devices into the water flowable state using the second water flow switching valve to perform the circulation heat keeping operation and in performing the circulation heat keeping operation, when a flow amount detected by the second flow amount sensor of the second hot water supply device which is brought into the water flowable state becomes equal to or more than the hot-water-supply detection flow amount, finishes the circulation heat keeping operation, and performs the hot-water supply operation, and in performing the hot-water supply operation, changes the number of the second hot water supply devices to be brought into the water flowable state in accordance with a total amount of the flows detected by the second flow amount sensors of the second hot water supply devices being in the water flowable state.

This configuration enables efficiently performing the hot-water supply operation in accordance with the usage flow amount of hot water by changing the number of the second hot water supply devices to be brought into the water flowable state in accordance with the total amount of the flows detected by the second flow amount sensors of the second hot water supply devices in the water flowable state during in performing the hot-water supply operation.

In addition, the immediate hot-water supplying system of the present invention, the first hot water supply device comprises a first flow amount sensor configured to detect a flow amount of water flowing from the first supply pipe, and a first water flow switching valve configured to switch between a water flowable state in which water is enabled to flow from the first supply pipe to the first heating unit, and a water unflowable state in which water is disabled from flowing from the first supply pipe to the first heating unit, and a plurality of first hot-water supplying units each including the first hot water supply device and the first supply pipe, wherein the controlling unit changes, in performing the hot-water supply operation, the number of the first hot water supply devices to be brought into the water flowable state in accordance with the total amount of the flows detected by the first flow amount sensors of the first hot water supply devices being in the water flowable state.

This configuration enables efficiently performing the hot-water supply operation in accordance with the usage flow of hot water by changing the number of the first hot water supply devices to be brought into the water flowable state in accordance with the total amount of the flow amount detected by the first flow amount sensors of the first hot water supply devices in the water flowable state during performing the hot-water supply operation.

BRIEF DESCRIPTION OF THE DRAWINGS

FIG. 5A is a setting table showing the degrees of priority of hot water supply devices, and FIG. 5B is a setting table showing the degrees of priority of the hot water supply devices in another specification.

DETAILED DESCRIPTION OF THE PREFERRED EMBODIMENT

Figure 1:
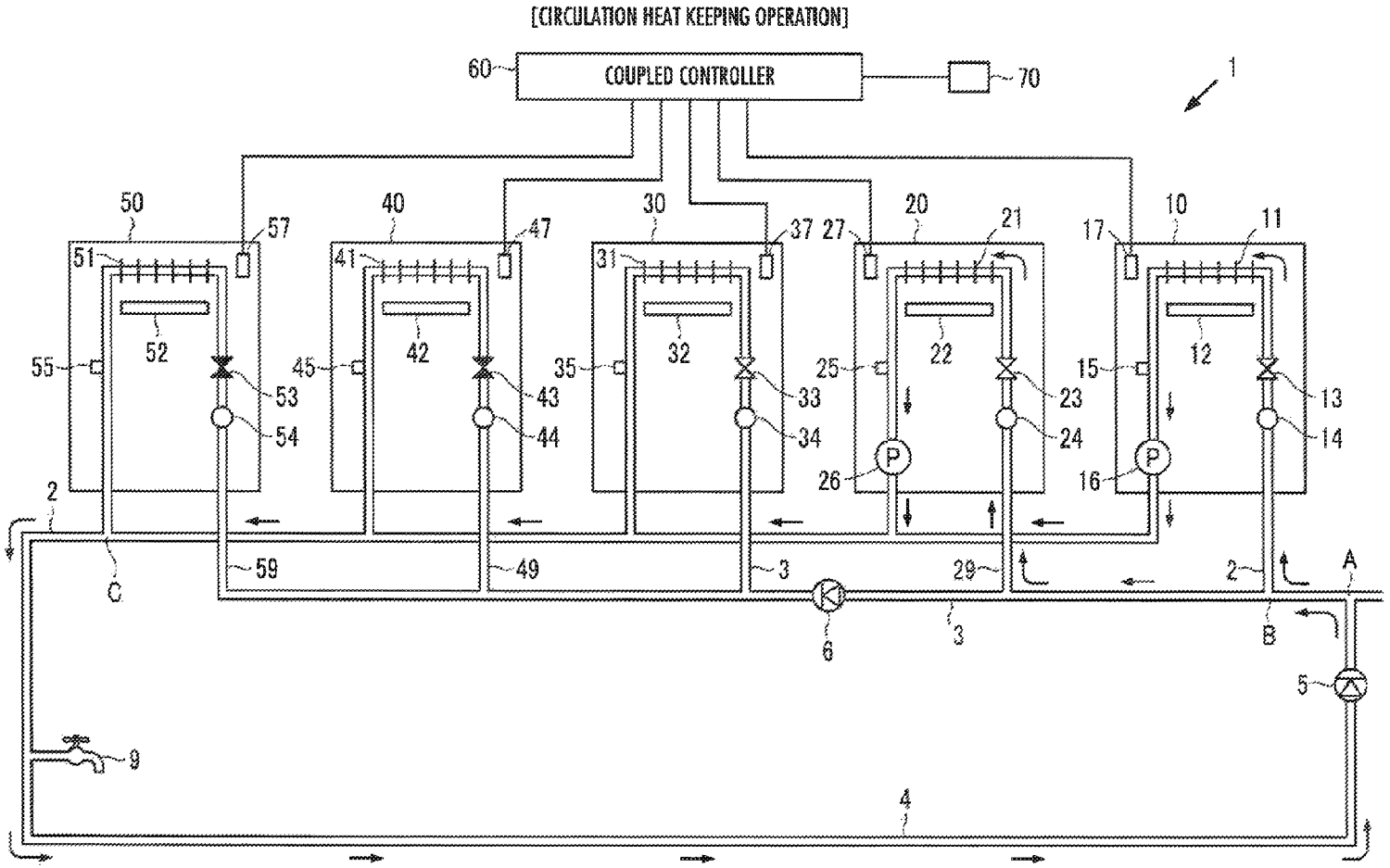
FIG. 1 is a configuration diagram of an immediate hot-water supplying system (circulation heat keeping operating state)

An embodiment of the present invention will be described with reference to FIG. 1 to FIG. 5. Referring to FIG. 1, an immediate hot-water supplying system 1 of the present embodiment is of a coupled hot water supplier type, and includes five hot water supply devices 10, 20, 30, 40, and 50, a coupled controller 60 coupled to the hot water supply devices 10, 20, 30, 40, and 50 in such a manner as to communicate with them, and a remote control 70 coupled to the coupled controller 60 in such a manner as to communicate with it.

In addition, the immediate hot-water supplying system 1 includes a first supply pipe 2 having one end connected to a waterworks and the other end connected to a hot-water tap 9, a return pipe 4 configured to connect between a connection point of the first supply pipe 2 and the hot-water tap 9, and a connection point of the first supply pipe 2 and the waterworks, and a check valve 5 provided in the return pipe 4 and configured to enable flowing water from the return pipe 4 to the first supply pipe 2 and disable water flowing from the first supply pipe 2 to the return pipe 4.

The hot water supply device 10 includes a first heat exchanger 11 connected on the way of the first supply pipe 2, a first burner 12 configured to heat the first heat exchanger 11, a first water-volume servo 13 configured to adjust the degree of opening of the first supply pipe 2 (having a function of a first water flow switching valve of the present invention), a first flow amount sensor 14 configured to detect the flow of water supplied from the first supply pipe 2, a first temperature sensor 15 configured to detect the temperature of water to flow into the first supply pipe 2, a circulation pump 16 configured to suck water from the first supply pipe 2, and to circulate water in a circulation circuit including the first supply pipe 2 and the return pipe 4, and a first hot-water supply controller 17 configured to control the action of the hot water supply device 10.

Note that the first heat exchanger 11 and the first burner 12 constitute a first heating unit of the present invention. In addition, the first hot-water supply controller 17 is an electronic circuit unit composed of, for example, a CPU and memory (not shown), and executes a control program for the hot water supply device 10 stored in the memory using the CPU so as to serve a function of controlling the action of the hot water supply device 10. In addition, the first supply pipe 2 and the hot water supply device 10 constitute a first hot-water supplying unit of the present invention.

The hot water supply device 20 is connected on the way of a branched pipe 29, which branches off from the first supply pipe 2 and connects the upstream side and the downstream side of the hot water supply device 10. Similar to the hot water supply device 10, the hot water supply device 20 includes, as with the hot water supply device 10, a first heat exchanger 21, a first burner 22, a first water-volume servo 23 (having the function of the first water flow switching valve of the present invention), a first flow amount sensor 24, a first temperature sensor 25, a circulation pump 26, and a hot-water supply controller 27.

Note that the first heat exchanger 21 and the first burner 22 constitute the first heating unit of the present invention. In addition, the hot-water supply controller 27 is an electronic circuit unit composed of, for example, a CPU and memory (not shown), and executes a control program for the hot water supply device 20 stored in the memory using the CPU so as to serve a function of controlling the action of the hot water supply device 20. In addition, the branched pipe 29 (equivalent to the first supply pipe of the present invention) and the hot water supply device 20 constitute the first hot-water supplying unit of the present invention.

In addition, in the following description, the hot water supply devices 10 and 20 including the circulation pumps 16 and 26 are referred to as P hot water supply devices (hot water supply devices with pump, corresponding to first hot water supply devices of the present invention) 10 and 20.

Next, the hot water supply device 30 is connected on the way of a second supply pipe 3, which branches off from the first supply pipe 2 and connects the upstream side and the downstream side of the P hot water supply devices 10 and 20. The hot water supply device 30 includes a second heat exchanger 31 connected on the way of the second supply pipe 3, a second burner 32 configured to heat the second heat exchanger 31, a second water-volume servo 33 configured to change the degree of opening of the second supply pipe 3 (having a function of a second water flow switching valve of the present invention), a second flow amount sensor 34 configured to detect the flow amount of water flowing from the second supply pipe 3, a second temperature sensor 35 configured to detect the temperature of water flowing into the second supply pipe 3, and a second hot-water supply controller 37 configured to control the action of the hot water supply device 30. The second supply pipe 3 includes a check valve 6 configured to enable water flowing from the second supply pipe 3 to the hot water supply device 30, and disable water flowing from the hot water supply device 30 to the second supply pipe 3.

Note that the second heat exchanger 31 and the second burner 32 constitute a second heating unit of the present invention. In addition, the second hot-water supply controller 37 is an electronic circuit unit composed of, for example, a CPU and memory (not shown), and executes a control program for the hot water supply device 30 stored in the memory so as to serve a function of controlling the action of the hot water supply device 30. In addition, the second supply pipe 3 and the hot water supply device 30 constitute a second hot-water supplying unit of the present invention.

The hot water supply device 40 is connected on the way of a branched pipe 49, which branches off from the second supply pipe 3 and connects the upstream side and the downstream side of the hot water supply device 30. Similar to the hot water supply device 30, the hot water supply device 40 includes a second heat exchanger 41, a second burner 42, a second water-volume servo 43 (having the function of the second water flow switching valve of the present invention), a second flow amount sensor 44, a second temperature sensor 45, and a second hot-water supply controller 47.

Note that the second heat exchanger 41 and the second burner 42 constitute the second heating unit of the present invention. In addition, the second hot-water supply controller 47 is an electronic circuit unit composed of, for example, a CPU and memory (not shown), and executes a control program for the hot water supply device 40 stored in the memory so as to serve a function of controlling the action of the hot water supply device 40. In addition, the branched pipe 49 (corresponding to the second supply pipe of the present invention) and the hot water supply device 40 constitute the second hot-water supplying unit of the present invention.

The hot water supply device 50 is connected on the way of a branched pipe 59, which branches off from the second supply pipe 3 and connects the upstream side and the downstream side of the hot water supply devices 30 and 40. Similar to the hot water supply devices 30 and 40, the hot water supply device 50 includes a second heat exchanger 51, a second burner 52, a second water-volume servo 53 (having the function of the second water flow switching valve of the present invention), a second flow amount sensor 54, a second temperature sensor 55, and a hot-water supply controller 57.

Note that the second heat exchanger 51 and the second burner 52 constitute the second heating unit of the present invention. In addition, the hot-water supply controller 57 is an electronic circuit unit composed of, for example, a CPU and memory (not shown), and executes a control program for the hot water supply device 50 stored in the memory so as to serve a function of controlling the action of the hot water supply device 50.

In addition, the branched pipe 59 (corresponding to the second supply pipe of the present invention) and the hot water supply device 50 constitute the second hot-water supplying unit of the present invention.

In addition, in the following description, the hot water supply devices 30, 40, and 50 including no circulation pumps are referred to as N hot water supply devices (hot water supply devices without pump, corresponding to second hot water supply device of the present invention) 30, 40, and 50.

The coupled controller 60 is an electronic circuit unit including a CPU and memory (not shown), and communicates with the first hot-water supply controllers 17 and 27 and the second hot-water supply controllers 37, 47, and 57 of the hot water supply devices 10, 20, 30, 40, and 50, to instruct the hot water supply devices 10, 20, 30, 40, and 50 to action, and to detect the states of the hot water supply devices 10, 20, 30, 40, and 50.

The coupled controller 60 is connected to the remote control 70, and a user can control the remote control 70 to set the temperature of hot water supplied from the hot-water tap 9 (a target temperature of supplied water), a time period for which the circulation heat keeping operation is performed (circulation heat keeping time period), and the like.

According to flow charts shown in FIG. 3 and FIG. 4, procedures to perform a "circulation heat keeping operation" and a "hot-water supply operation" by the coupled controller 60 will be described below. Note that a configuration in which the coupled controller 60 performs the "circulation heat keeping operation" and the "hot-water supply operation" correspond to a controlling unit of the present invention.

Figure 3:
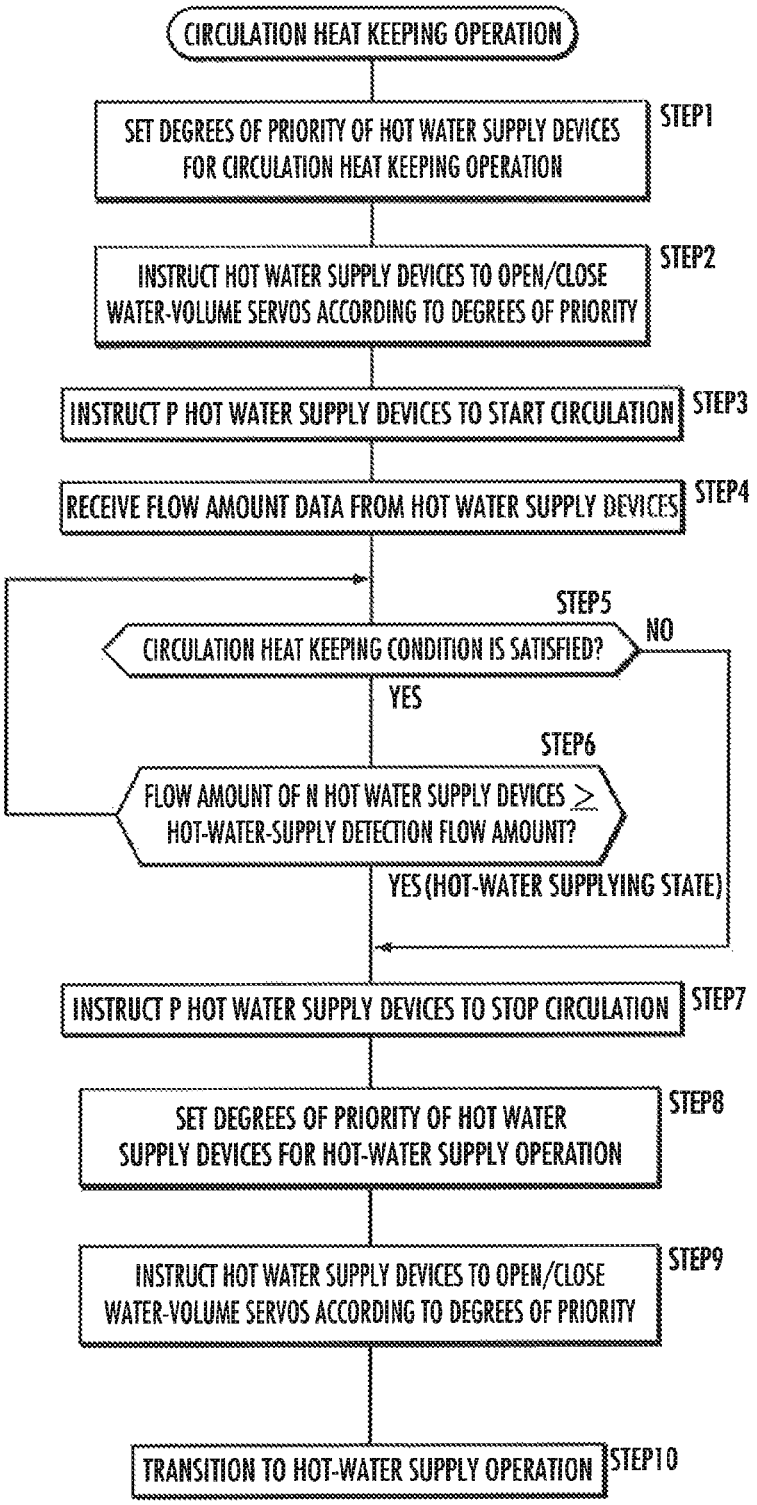
FIG. 3 is a flow chart of the circulation heat keeping operation.

FIG. 3 is a flow chart of the "circulation heat keeping operation." In STEP 1, the coupled controller 60 sets the degrees of priority of the hot water supply devices 10, 20, 30, 40, and 50 for the circulation heat keeping operation. The coupled controller 60 sets the degrees of priority of the hot water supply devices 10, 20, 30, 40, and 50 according to a setting table shown in FIG. 5A.

As shown in FIG. 5A, in the present embodiment, connectors No. 1 to No. 5 of the coupled controller 60 are configured such that No. 4 is connected to the P hot water supply device 10, No. 5 is connected to the P hot water supply device 20, No. 1 is connected to the N hot water supply device 30, No. 2 is connected to the N hot water supply device 40, and No. 3 is connected to the N hot water supply device 50.

Then, according to the setting table in FIG. 5A, in the hot-water supply operation, the coupled controller 60 sets priorities in a descending order of P hot water supply device 10→P hot water supply device 20→N hot water supply device 30→N hot water supply device 40→N hot water supply device 50 (priority order for the hot-water supply operation).

In addition, in the circulation heat keeping operation, the coupled controller 60 sets the priority order in a descending order of P hot water supply devices 10 and 20→N hot water supply device 30→N hot water supply device 40→N hot water supply device 50 (priorities of the circulation heat keeping operation). In this case, the P hot water supply devices 10 and 20 have the same priority.

In subsequent STEP 2, the coupled controller 60 transmits, according to the priorities, control signals to instruct the first water-volume servos 13 and 23 to open the valves, to the P hot water supply devices 10 and 20. Furthermore, the coupled controller 60 transmits control signals to instruct the second water-volume servos 43 and 53 to close the valves, to the N hot water supply devices 40 and 50.

Figure 2:
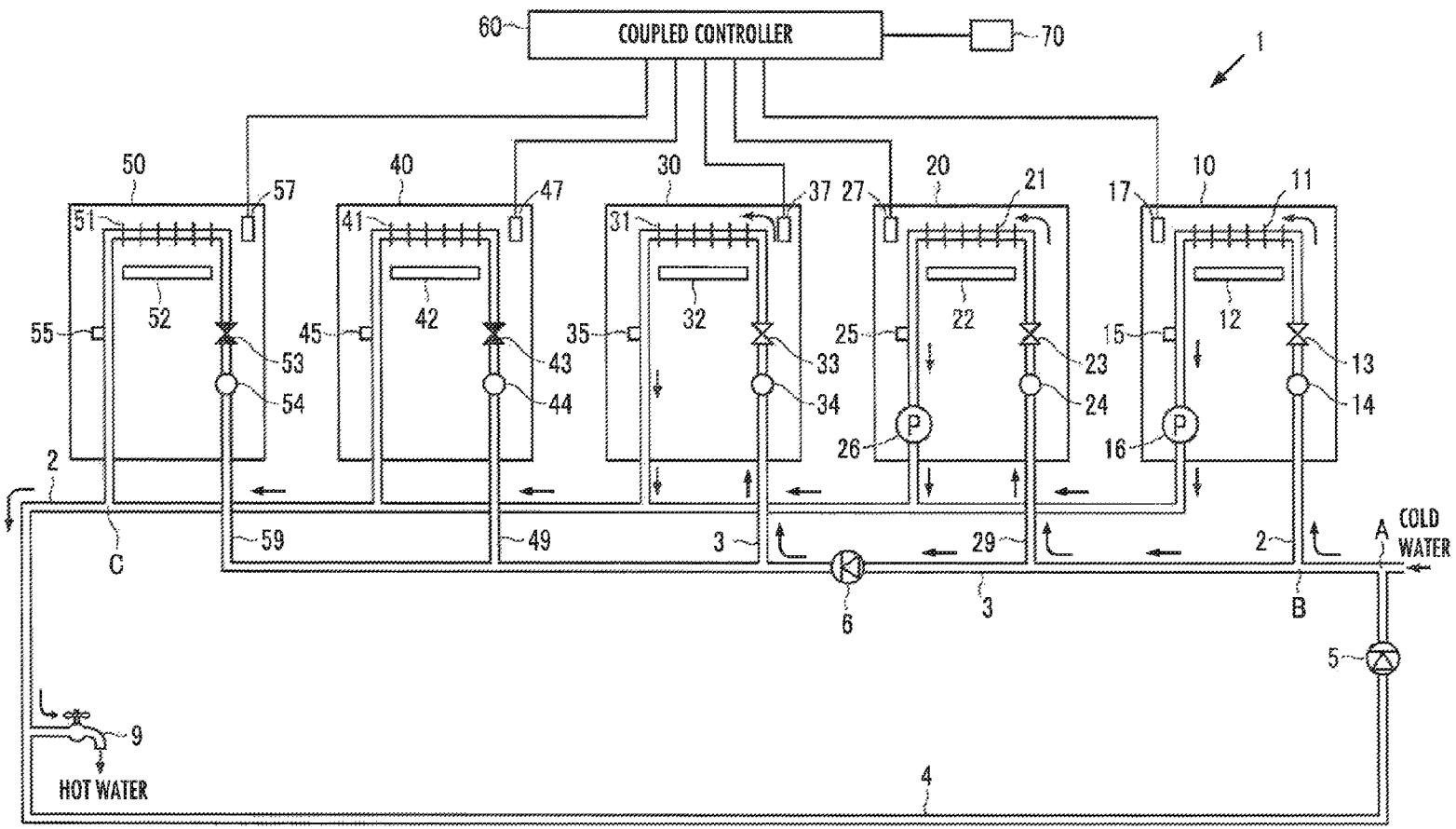
FIG. 2 is a configuration diagram of the immediate hot-water supplying system (hot-water supply operating state)

In such a manner, as shown in FIG. 1 and FIG. 5A, the P hot water supply devices 10 and 20 and the N hot water supply device 30 are brought into a state that the valves of the first water-volume servos 13 and 23 and the second water-volume servo 33 are opened (water flowable state, shown by solid-white triangles in FIGS. 1 and 2). In addition, the N hot water supply devices 40 and 50 are brought into a state that the valves of the second water-volume servos 43 and 53 are closed (water unflowable state, shown by solid-black triangles in FIGS. 1 and 2).

In next STEP 3, the coupled controller 60 transmits control signals to instruct the start of circulation, to the first hot-water supply controllers 17 and 27 of the P hot water supply devices 10 and 20. The first hot-water supply controllers 17 and 27 that have received these control signals starts the action of the circulation pumps 16 and 26, which starts the circulation of the water in the circulation circuit including the first supply pipe 2, the branched pipe 29, and the return pipe 4, as shown in FIG. 1.

When the flow amount detected by the first flow amount sensor 14 is equal to or more than a hot-water-supply detection flow amount (ignition flow amount), the first hot-water supply controller 17 controls the heating power of the first burner 12 such that the detected temperature of the first temperature sensor 15 becomes the target temperature of supplied water. Similarly, when the flow detected by the first flow amount sensor 24 is equal to or more than the hot-water-supply detection flow amount, the hot-water supply controller 27 controls the heating power of the first burner 22 such that the detected temperature of the first temperature sensor 25 becomes the target temperature of supplied water.

This starts the "circulation heat keeping operation," in which the water in the circulation circuit including the first supply pipe 2, the branched pipe 29, and the return pipe 4 are circulated while heated by the P hot water supply devices 10 and 20.

In next STEP 4, the coupled controller 60 transmits control signals to request the first hot-water supply controllers 17 and 27 and the second hot-water supply controllers 37, 47, and 57 of the hot water supply devices 10, 20, 30, 40, and 50 to transmit data on flow amounts detected by the flow amount sensors (first flow amount sensors 14 and 24, and second flow amount sensors 34, 44, and 54). Then the coupled controller 60 receives the data on the flow amounts detected by the flow amount sensors (first flow amount sensors 14 and 24, and second flow amount sensors 34, 44, and 54) from the first hot-water supply controllers 17 and 27 and the second hot-water supply controllers 37, 47, and 57.

In subsequent STEP 5, the coupled controller 60 determines, in performing the "circulation heat keeping operation," whether or not a circulation heat keeping condition holds. The circulation heat keeping condition is set to hold when at least the following two conditions are satisfied.

(a) The current time is in the circulation heat keeping time period which has been set by the remote control 70, and (b) A start operation of the circulation heat keeping is performed by remote control 70.

When the circulation heat keeping condition holds, the coupled controller 60 proceeds to STEP 6 and determines whether or not the flow amount detected by the second flow amount sensor 34 of the N hot water supply device 30 is equal to or more than the hot-water-supply detection flow amount.

When the flow amount detected by the second flow amount sensor 34 is less than the hot-water-supply detection flow amount in STEP 6, which means a state that no water flows from the second supply pipe 3 to the N hot water supply device 30, it can be determined that the hot-water tap 9 is closed. Thus, the coupled controller 60 returns to STEP 5 in this case to continue the control for the "circulation heat keeping operation."

In contrast, when the flow amount detected by the second flow amount sensor 34 is equal to or more than the hot-water-supply detection flow amount in STEP 6, which means a state that water flows from the second supply pipe 3 to the N hot water supply device 30, it can be determined that the hot-water tap 9 is opened.

For this reason, the coupled controller 60 proceeds to STEP 7 in this case and transmits control signals to instruct the circulation pumps 16 and 26 to stop to the first hot-water supply controller 17 of the P hot water supply device 10 and the first hot-water supply controller 27 of the P hot water supply device 20, so as to stop the circulation pumps 16 and 26.

In subsequent STEP 8, the coupled controller 60 sets the priority order of the hot water supply devices 10, 20, 30, 40, and 50 to the priorities for the hot-water supply operation shown in FIG. 5A. In next STEP 9, according to the priority order, the coupled controller 60 transmits a control signal to instruct to open the valve of the first water-volume servo 13, to the first hot-water supply controller 17 of the P hot water supply device 10 having the highest priority order, and transmits control signals to instruct to close the valves of the water-volume servos 23, 33, 43, and 53, to the first hot-water supply controller 27 and the second hot-water supply controllers 37, 47, and 57 of the other hot water supply devices 20, 30, 40, and 50.

This causes only the first water-volume servo 13 of the P hot water supply device 10 to open the valve, and causes the water-volume servos 23, 33, 43, and 53 of the other hot water supply devices 20, 30, 40, and 50 to be the closed valve state. Then, the coupled controller 60 proceeds to subsequent STEP 9 and transitions from the control for the "circulation heat keeping operation" to the control for the "hot-water supply operation."

In addition, the coupled controller 60 causes the procedure to branch to STEP 7 also when the circulation heat keeping condition does not hold in STEP 5, and transitions from the control for "circulation heat keeping operation" to the control for the "hot-water supply operation."

Next, the procedure to perform the "hot-water supply operation" by the coupled controller 60 will be described with reference to FIG. 4.

Figure 4:
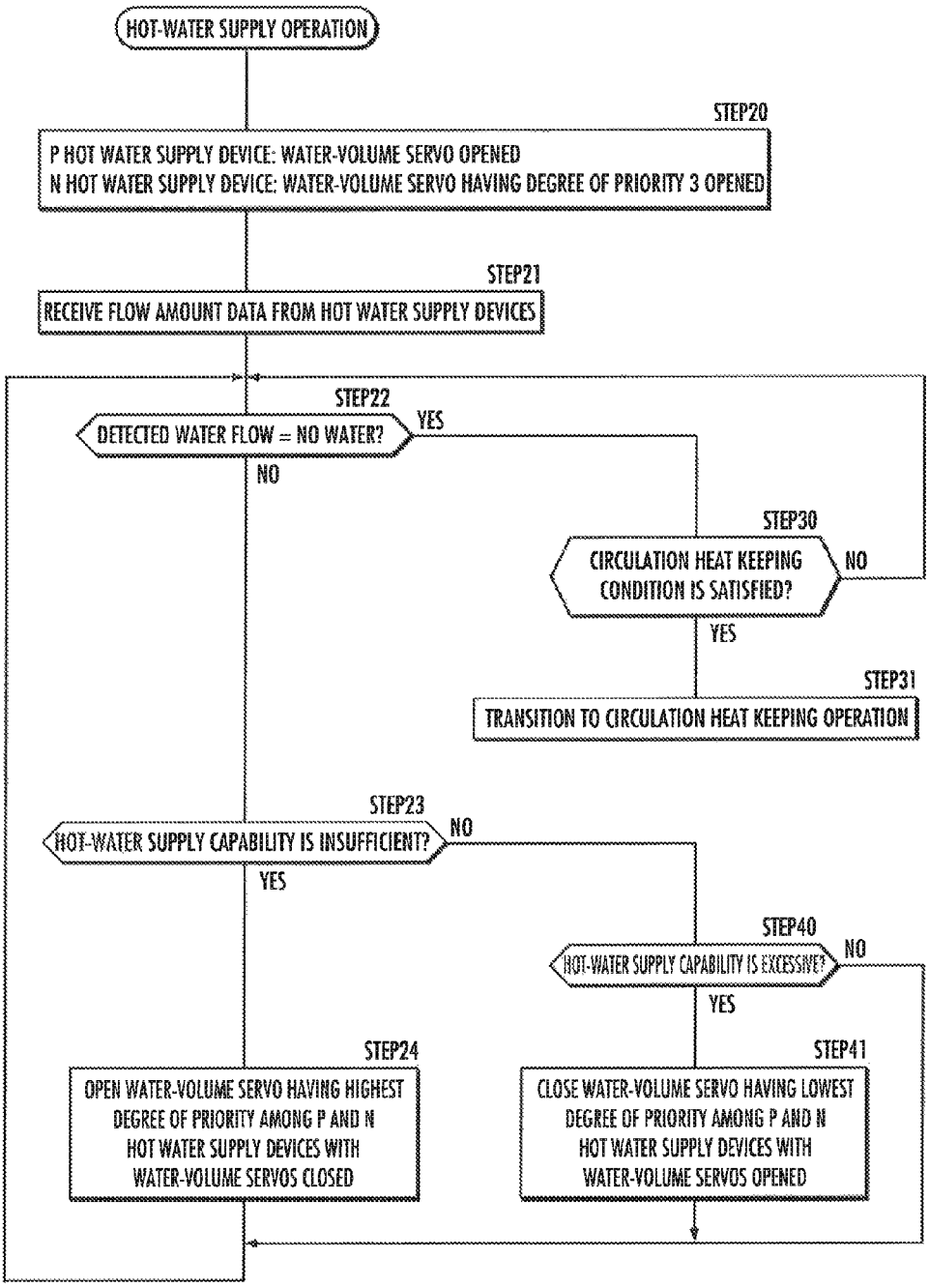
FIG. 4 is a flow chart of the hot-water supply operation.

In STEP 20 in FIG. 4, the coupled controller 60 transmits control signals to instruct to open the valves of the water-volume servos (the first water-volume servos 13 and 23, and the second water-volume servo 33) to the first hot-water supply controllers 17 and 27 of the P hot water supply devices 10 and 20 and the second hot-water supply controller 37 of the N hot water supply device 30 that have degrees of priority 1 to 3, and transmits control signals to instruct to close the valves of the water-volume servos (second water-volume servos 43 and 53) to the second hot-water supply controllers 47 and 57 of the N hot water supply devices 40 and 50 that have degrees of priority 4 to 5.

This causes, as shown in FIG. 2, the first water-volume servos 13 and 23 of the P hot water supply devices 10 and 20 and the second water-volume servo 33 of the N hot water supply device 30 to open the valves, and causes the second water-volume servos 43 and 53 of the P hot water supply devices 40 and 50 to close the valves.

In FIG. 2, the first water-volume servos 13 and 23 and the second water-volume servo 33 in a valve-opened state are shown by solid-white triangles, and the second water-volume servos 43 and 53 in a valve-closed state are shown by solid-black triangles. In the state of FIG. 2, water that has been heated by the first heat exchangers 11 and 21 of the P hot water supply devices 10 and 20 and the second heat exchanger 31 of the N hot water supply device 30 is supplied through the hot-water tap 9.

In subsequent STEP 21, the coupled controller 60 transmits signals to request data on the flow amount detected by the first flow amount sensors 14 and 24 and the second flow amount sensors 34, 44, and 54, to first hot-water supply controllers 17 and 27 of the P hot water supply devices 10 and 20 and the second hot-water supply controllers 37, 47, and 57 of the N hot water supply devices 30, 40, and 50, respectively.

The coupled controller 60 receives the data on the flow amount detected by the first flow amount sensors 14 and 24 and the second flow amount sensors 34, 44, and 54, from the first hot-water supply controllers 17 and 27 and the second hot-water supply controllers 37, 47, and 57, respectively. Then, the coupled controller 60 recognizes the flow amount detected by the first flow amount sensors 14 and 24 and the second flow amount sensors 34, 44, and 54.

In subsequent STEP 22, the coupled controller 60 determines whether or not the total amount of the flows detected by the first flow amount sensors 14 and 24 and the second flow amount sensors 34, 44, and 54 indicates that no water flows (the total amount of the detected flows is zero). Then, when the total flow amount of the detected flows indicates that water flows, the coupled controller 60 proceeds to STEP 23 and determines whether or not the hot-water supply capability is insufficient based on the total amount of the detected flows. In addition, when the total amount of the detected flows indicates that no water flows in STEP 22, the coupled controller 60 proceeds to STEP 30 and determines whether or not the circulation heat keeping condition holds.

Specifically, the coupled controller 60 determines that the hot-water supply capability is insufficient every time the total amount of the detected flows exceeds one of a plurality of preset threshold values, and proceeds to STEP 24. Then, with respect to the five hot water supply devices 10, 20, 30, 40, and 50, the coupled controller 60 causes the water-volume servo of a hot water supply device having the highest degree of priority among the hot water supply devices in which the water-volume servos (the first water-volume servos 13 and 23, and the second water-volume servos 33, 43, and 53) in which the valves are closed, to open the valve, so as to increase the number of the hot water supply devices in the operating state (a state that flowing water is heated) and returns to STEP 22.

In contrast, when determining in STEP 23 that the hot-water supply capability is sufficient, the coupled controller 60 causes the procedure to branch to STEP 40, and determines whether or not the hot-water supply capability is excessive. Specifically, the coupled controller 60 determines that the hot-water supply capability is excessive every time the total amount of the flow detected by the first flow amount sensors 14 and 24 and the second flow amount sensors 34, 44, and 54 is less than the threshold values having a plurality of levels, and proceeds to STEP 41.

Then, with respect to the five hot water supply devices 10, 20, 30, 40, and 50, the coupled controller 60 causes the water-volume servo of a hot water supply device having the lowest degree of priority among the hot water supply devices in which the water-volume servos (the first water-volume servos 13 and 23, and the second water-volume servos 33, 43, and 53) in which the valves are opened (the hot water supply devices in the operating state) to close the valve, so as to decrease the number of the hot water supply devices in the operating state.

In addition, when determining in STEP 40 that the hot-water supply capability is not excessive, the coupled controller 60 proceeds from STEP 40 to STEP 22, and in this case, the number of the hot water supply devices in the operating state is not changed.

Note that, in the present embodiment, as shown in FIG. 5A, the degree of priority is set continuously regarding the P hot water supply devices 10 and 20 and the N hot water supply devices 30, 40, and 50. However, as shown in FIG. 5B, the priority order may be set separately to the P hot water supply devices 10 and 20, and to the N hot water supply devices 30, 40, and 50.

In this case, for example, it is possible in the circulation heat keeping operation to perform a control of switching between a case of activating only the circulation pump 16 of the P hot water supply device 10, and a case of activating both the circulation pump 16 of the P hot water supply device 10 and the circulation pump 26 of the P hot water supply device 20, in accordance with the circulation load.

In addition, it is possible in the hot-water supply operation to perform a control of activating the N hot water supply devices 30, 40, and 50 with priority with respect to the P hot water supply devices 10 and 20, to try the equalization of the total operation time of the hot water supply devices 10, 20, 30, 40, and 50.

In addition, the present embodiment has described the example in which the coupled controller 60 is provided separately from the hot water supply devices 10, 20, 30, 40, and 50. However, the functions of the coupled controller 60 may be included in the hot-water supply controller of any one of the hot water supply devices. In this case, the configuration is that the remote control is connected to the hot-water supply controller.

In addition, the present embodiment has described the immediate hot-water supplying system including two P hot water supply devices and three N hot water supply devices.

However, the present invention can be applied as long as the immediate hot-water supplying system includes at least one P hot water supply device and at least one N hot water supply device.

In addition, the present embodiment has described the hot water supply device including the burner (e.g., gas burner and kerosene burner). However, a hot water supply device using other kinds of heat sources such as electricity may be used.

REFERENCE SIGNS LIST

1 immediate hot-water supplying system
2 first supply pipe
3 second supply pipe
4 return pipe
5, 6 check valve
29, 39, 49, 59 branched pipe
10, 20 P (with a circulation pump) hot water supply device
17, 27 first hot-water supply controller
30, 40, 50 N (without circulation pump) hot water supply device
11, 21 first heat exchanger
12, 22 first burner
13, 23 first water-volume servo
14, 24 first flow amount sensor
15, 25 first temperature sensor
16, 26 circulation pump
31, 41, 51 second heat exchanger
32, 42, 52 second burner
33, 43, 53 second water-volume servo
34, 44, 54 second flow amount sensor
37, 47, 57 second hot-water supply controller
60 coupled controller
70 remote control

What is claimed is:

1. An immediate hot-water supplying system, comprising:

a first supply pipe having one end connected to a waterworks and the other end connected to a hot-water tap;

a return pipe configured to communicate between the one end and the other end of the first supply pipe;

a first hot water supply device including a first heating unit which is provided along the first supply pipe and configured to heat water flowing through the first supply pipe, and a circulation pump configured to circulate water in a circulation circuit including the first supply pipe and the return pipe;

a second supply pipe having one end connected to an upstream side of the first hot water supply device of the first supply pipe and the other end connected to a downstream side of the first hot water supply device of the first supply pipe;

a second hot water supply device including a second heating unit which is provided along the second supply pipe and configured to heat water flowing through the second supply pipe, and a second flow amount sensor configured to detect a flow amount of water flowing from the second supply pipe;

a check valve configured to enable water to flow from the second supply pipe to the second hot water supply device, and disable water to flow from the second hot water supply device to the second supply pipe; and a controlling unit configured to, start to perform a circulation heat keeping operation by starting operation of the circulation pump for circulating water in the circulation circuit and starting operation of the first heating unit heating water for flowing through the first supply pipe, when the flow amount detected by the second flow amount sensor when the circulation heat keeping operation is performed is less than a predetermined hot-water-supply detection flow amount, continue to perform the circulation heat keeping operation by continuing operation of the first heating unit and the circulation pump, and when the flow amount detected by the second flow amount sensor when the circulation heat keeping operation is performed is equal to or more than the hot-water-supply detection flow amount, stop at least operation of the circulation pump to stop performing the circulation heat keeping operation and perform a hot-water supply operation by at least one of a first sub-operation and a second sub-operation, wherein: the first sub-operation is continuing operation of the first heating unit for heating water flowing through the first supply pipe when the first heating unit is previously in operation, and starting operation of the first heating unit for heating water flowing through the first supply pipe when the first heating unit is previously not in operation; and the second sub-operation is starting operation of the second heating unit for heating water flowing through the second supply pipe, wherein the circulation pump is configured to circulate water in the circulation circuit including the first supply pipe and the return pipe through only the first hot water supply device, among the first hot water supply device and the second hot water supply device.

2. The immediate hot-water supplying system according to claim 1, wherein the second hot water supply device includes a second water flow switching valve configured to switch between a water flowable state in which water is enabled to flow from the second supply pipe to the second heating unit, and a water unflowable state in which water is disabled from flowing from the second supply pipe to the second heating unit, the system further comprising a plurality of second hot-water supplying units each including the second hot water supply device, the plurality of second hot-water supplying units sharing the second supply pipe and the check valve, wherein the check valve is configured to enable water to flow from the second supply pipe to the second hot water supply device of each of the plurality of second hot-water supplying units, and disable water to flow from the second hot water supply device of each of the plurality of second hot-water supplying units to the second supply pipe, wherein the controlling unit brings the second hot water supply device of at least one of the plurality of second hot-water supplying units into the water flowable state using the second water flow switching valve thereof to perform the circulation heat keeping operation, and during performing the circulation heat keeping operation, when a flow amount detected by the second flow amount sensor of the second hot water supply device which is brought into the water flowable state becomes equal to or more than the hot-water-supply detection flow amount, and the controlling unit finishes the circulation heat keeping operation by stopping at least operation of the circulation pump, to perform the hot-water supply operation, and during performing the hot-water supply operation, changes a number of the second hot water supply devices to be brought into the water flowable state in accordance with a total amount of the flow amount detected by the second flow amount sensors of the second hot water supply devices being in the water flowable state.

3. The immediate hot-water supplying system according to claim 2, wherein the first hot water supply device includes a first flow amount sensor configured to detect a flow amount of water flowing from the first supply pipe, and a first water flow switching valve configured to switch between a water flowable state in which water is enabled to flow from the first supply pipe to the first heating unit, and a water unflowable state in which water is disabled from flowing from the first supply pipe to the first heating unit, the system further comprising a plurality of first hot-water supplying units each including the first hot water supply device and sharing the first supply pipe, wherein the controlling unit changes a number of the first hot water supply devices to be brought into the water flowable state in accordance with a total amount of the flow amount detected by the first flow amount sensors of the first hot water supply devices being in the water flowable state, during performing the hot-water supply operation.

4. The immediate hot-water supplying system according to claim 1, wherein the first hot water supply device includes a first flow amount sensor configured to detect a flow amount of water flowing from the first supply pipe, and a first water flow switching valve configured to switch between a water flowable state in which water is enabled to flow from the first supply pipe to the first heating unit, and a water unflowable state in which water is disabled from flowing from the first supply pipe to the first heating unit, the system further comprising a plurality of first hot-water supplying units each including the first hot water supply device and sharing the first supply pipe, wherein the controlling unit changes a number of the first hot water supply devices to be brought into the water flowable state in accordance with a total amount of the flow amount detected by the first flow amount sensors of the first hot water supply devices being in the water flowable state, during performing the hot-water supply operation.

5. An immediate hot-water supplying system, comprising:

a first supply pipe having one end connected to a waterworks and the other end connected to a hot-water tap;

a return pipe configured to communicate between the one end and the other end of the first supply pipe;

a plurality of first hot water supply devices, each including a first heating unit which is provided along the first supply pipe and configured to heat water flowing through the first supply pipe, and a circulation pump configured to circulate water in a circulation circuit including the first supply pipe and the return pipe;

a second supply pipe having one end connected to an upstream side of the plurality of first hot water supply devices of the first supply pipe and the other end connected to a downstream side of the plurality of first hot water supply devices of the first supply pipe;

a second hot water supply device including a second heating unit which is provided along the second supply pipe and configured to heat water flowing through the second supply pipe, and a second flow amount sensor configured to detect a flow amount of water flowing from the second supply pipe;

a check valve configured to enable water to flow from the second supply pipe to the second hot water supply device, and disable water to flow from the second hot water supply device to the second supply pipe; and a controlling unit configured to, start to perform a circulation heat keeping operation by starting operation of at least one circulation pump of the plurality of first hot water supply devices for circulating water in the circulation circuit and starting operation of at least one first heating unit of the plurality of first hot water supply devices heating water for flowing through the first supply pipe, when the flow amount detected by the second flow amount sensor the circulation heat keeping operation is performed is less than a predetermined hot-water-supply detection flow amount, continue to perform the circulation heat keeping operation by continuing operation of the at least one first heating unit and circulation pump of the plurality of first hot water supply devices, and when the flow amount detected by the second flow amount sensor when the circulation heat keeping operation is performed is equal to or more than the hot-water-supply detection flow amount, stop at least operation of the at least one circulation pump of the plurality of first hot water supply devices to stop performing the circulation heat keeping operation and perform a hot-water supply operation by at least one of a first sub-operation and a second sub-operation, wherein: the first sub-operation is continuing operation of the first heating unit for heating water flowing through the first supply pipe when the first heating unit is already in operation, and starting operation of the at least one first heating unit of the plurality of first hot water supply devices for heating water flowing through the first supply pipe when the first heating unit is not already in operation; and the second sub-operation is starting operation of the second heating unit for heating water flowing through the second supply pipe, wherein the circulation pump is configured to circulate water in the circulation circuit including the first supply pipe and the return pipe through only the first hot water supply device, among the first hot water supply device and the second hot water supply device.

* * * * *